United States Patent [19]

Wassenhoven

[11] Patent Number: 4,825,637

[45] Date of Patent: May 2, 1989

[54] FIBER OPENING DEVICE IN A SPINNING UNIT OF AN OPEN-END SPINNING MACHINE

[75] Inventor: Heinz-Georg Wassenhoven, Monchen-Gladbach, Fed. Rep. of Germany

[73] Assignee: W. Schlafhorst & Co., Fed. Rep. of Germany

[21] Appl. No.: 195,583

[22] Filed: May 18, 1988

[30] Foreign Application Priority Data

May 19, 1987 [DE] Fed. Rep. of Germany ..... 3715934

[51] Int. Cl.[4] ..... D01H 7/892

[52] U.S. Cl. ..... 57/412; 57/408

[58] Field of Search ..... 57/408, 409, 412

[56] References Cited

U.S. PATENT DOCUMENTS

| | | | |
|---|---|---|---|
| 3,762,146 | 10/1973 | Landwehrkamp | 57/412 |
| 3,797,218 | 3/1974 | Landwehrkamp et al. | 57/58.89 |
| 3,800,520 | 4/1974 | Schiltknecht | 57/408 X |
| 4,008,562 | 2/1977 | Vecera | 57/412 |
| 4,024,699 | 5/1977 | Goldammer et al. | 57/412 |
| 4,617,790 | 10/1986 | Stahlecker | 57/408 X |
| 4,742,675 | 5/1988 | Leifeld | 57/408 X |

FOREIGN PATENT DOCUMENTS

| | | |
|---|---|---|
| 1560331 | 3/1971 | Fed. Rep. of Germany . |
| 2721386 | 11/1978 | Fed. Rep. of Germany . |
| 3221385 | 12/1983 | Fed. Rep. of Germany . |
| 1373099 | 11/1974 | United Kingdom . |

*Primary Examiner*—Donald Watkins

*Attorney, Agent, or Firm*—Shefte, Pinckney & Sawyer

[57] ABSTRACT

A fiber opening device in a spinning unit of an open-end spinning machine wherein an opening roller is mounted within a housing with the housing being integrally formed from a drawing-in opening past a trash discharge opening to a fiber discharge opening and including integrally therewith a drawing-in trough and wall portions at the trash discharge opening. The housing is pivotally mounted to accommodate variations in the silver feed at the drawing-in roller. In an alternate form, the housing is stationary and the drawing-in roller is mounted for relative movement with respect thereto for the same purpose. The opening roller has a fiber opening surface to which the fibers are confined by side flanges on the opening roller and the trash discharge opening is of a width no greater than the width of the fiber opening surface. The opening roller inlcudes a drive shaft rotatably mounted in the housing so that the opening roller and housing are a unit for easy removal and replacement.

7 Claims, 2 Drawing Sheets

FIBER OPENING DEVICE IN A SPINNING UNIT OF AN OPEN-END SPINNING MACHINE

BACKGROUND OF THE INVENTION

The present invention relates to a fiber opening device in a spinning unit of an open-end spinning machine, and more particularly such a device having an opening roller rotatably mounted in a housing to which a sliver is fed by a drawing-in roller.

In open-end spinning, a sliver consisting of fibers that are generally parallel is combed to separate the fibers by an opening roller enclosed in a housing and the fibers are fed by air current in the housing to a fiber discharge opening in the housing from which they pass through a fiber guide tube to the spinning element, e.g. a spinning rotor.

As the fibers are of small size, even very small crevices between and within the components of the device, such as at edges and corners, can result in entrapment of individual fibers and the accumulation of a clump of fibers that disrupts the even flow of fibers that may ultimately break loose and pass into the spinning rotor to create a faulty slub in the yarn.

Typical of the known fiber opening devices in open-end spinning machines is the device disclosed in German patent document DE-PS No. 19 14 115, in which a trash discharge opening for separating trash, such as hull particles, dirt, etc., is formed in the housing between the drawing-in roller and the fiber discharge opening to the guide tube. Such a trash discharge opening will allow undesirable clumps of fibers to be discharged and not pass through the guide tube to the rotor, but it does not prevent the formation of clumps, which can result in faulty yarn, e.g. thin areas, during the formation of a clump of fibers prior to being broken loose and discharged. In known fiber opening devices, there are several locations at which fibers can be caught and accumulate in crevices. Typical of these are the pivoted feed trough, the drawing-in trough and the corners between the housing sidewalls and circumferential wall.

SUMMARY OF THE INVENTION

The present invention provides a fiber opening device of a construction in which the entanglement and accumulation of fibers is considerably reduced or avoided, thus providing a substantially trouble-free spinning operation.

Briefly described, the fiber opening device of the present invention includes an opening roller, a housing surrounding the opening roller, and a drawing-in roller. The housing surrounds the opening roller and has a drawing-in opening, a trash discharge opening and a fiber discharge opening, with the drawing-in roller being at the drawing-in opening. A drawing-in guide trough for guiding a strand of fibers to the drawing-in roller and drawing-in opening is formed integrally with the housing and the housing extends integrally from the drawing-in trough to the fiber discharge opening. Further, the housing and the drawing-in roller are relatively movable.

The integral, one-piece construction of the housing of the device of the present invention from at least the drawing-in opening to the fiber discharge opening substantially minimizes or eliminates undesirable crevices between a conventional drawing-in trough and the housing as well as between individual parts of a multi-part housing. Thus, there is little or no entanglement of fibers and accumulation of fibers in clumps that normally produce thin areas and slubs in the spun yarn.

As the drawing-in trough is no longer a movable component separate from the housing, the housing and drawing-in roller are mounted for relative movement to accommodate varying thicknesses in the fiber strand or sliver being fed to the device.

Preferably, the housing is mounted for pivoting about the axis of the opening roller so that relative movement between the housing and drawing-in roller will be accommodated simply by rotation of the housing without any variation in the spacing between the housing and the opening roller, and with the fibers being discharged through the fiber discharge opening into a stationary guide tube that transports the fibers to the rotor.

In an alternate embodiment, the housing is stationary and the drawing-in roller is mounted for movement in relation to the housing and drawing-in guide trough.

Also preferably, the housing has integral wall portions that define the trash opening. This minimizes fiber or trash entangling crevices that could be present were the wall portions separately attached to the housing.

In the preferred embodiment, the trash discharge opening is of a width no greater than the width of the fiber opening surface of the open roller to assure smooth guided flow of the fibers in the housing without significant lateral movement beyond the effective opening surface of the open roller.

Further, in the preferred embodiment the opening roller is mounted on a drive shaft that is rotatably mounted in the housing in a unitary construction that can be readily installed and replaced as a unit. This feature is particularly applicable to the embodiment in which the housing is pivoted about the opening roller shaft, wherein a bearing is required for support of the housing on the opening roller shaft.

Further features and advantages of the present invention will be apparent from the accompanying drawings and the following detailed description of the preferred embodiment.

DETAILED DESCRIPTION OF THE PREFERRED EMBODIMENT

Figure 1:
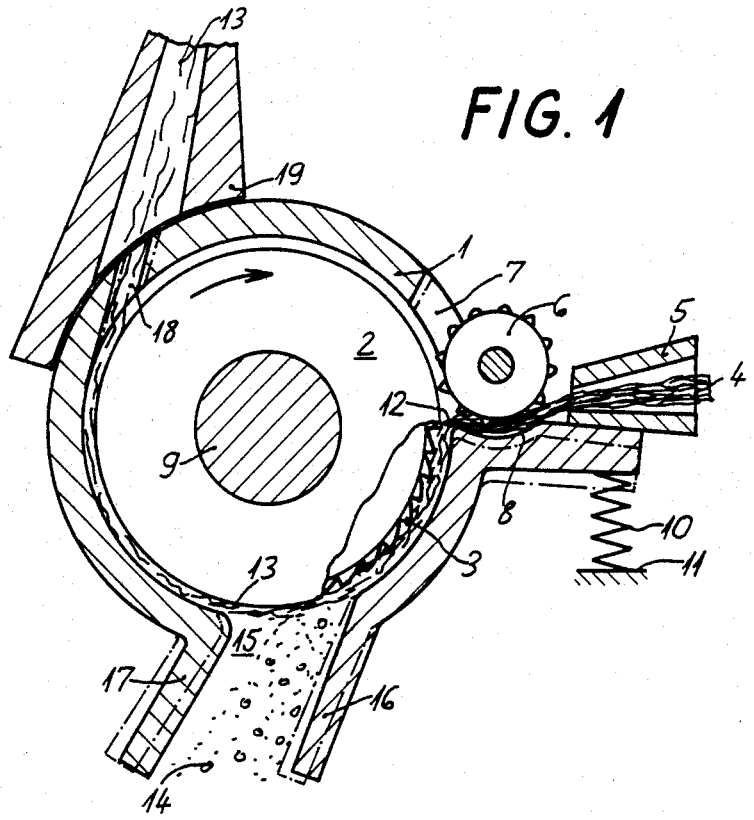
FIG. 1 is a vertical sectional view of a preferred embodiment of the fiber opening device of the present invention.
Figure 2:
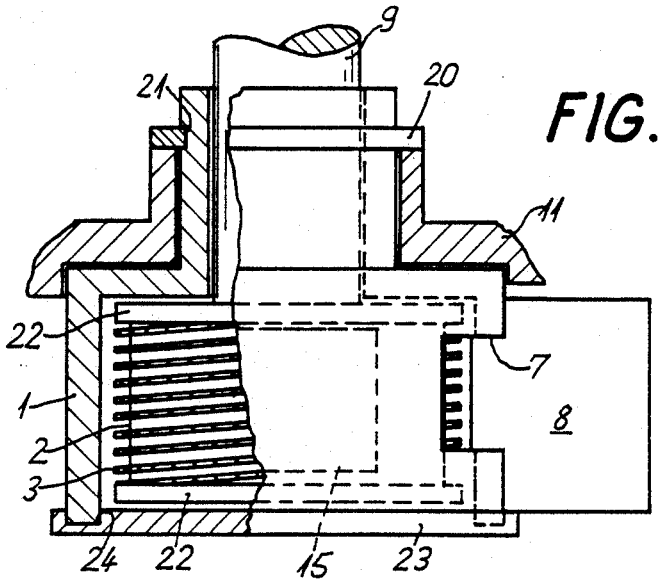
FIG. 2 is a plan view, partially in section, of the device of FIG. 1.

Referring to FIGS. 1 and 2, the fiber opening device of one preferred embodiment of the present invention is seen to include an opening roller 2 that is rotatably mounted in a housing 1. The roller has a fiber opening surface 3, illustrated in the form of a toothed wire clothing that is removably crimped into the roller surface.

A sliver 4 to be opened is fed to the opening roller 2 through a compressing tube 5 by a drawing-in roller 6 disposed at a drawing-in opening 7 in the housing 1. The drawing-in roller 6 is associated with a drawing-in trough 8 that is yieldable to accommodate variations in the sliver 4, such as variations in thickness. For this purpose the housing 1 is mounted for pivoting about the shaft 9 of the opening roller 2, with the housing normally being positioned by a spring 10 supported on the spinning unit 11, with the spring 10 allowing pivoting of the housing and urging the housing back into its normal operating position after an enlargement in the sliver has passed. The spring could be positioned at any other convenient location on the housing or it could be designed as a torsion-loaded spring concentrically mounted on the shaft 9 to engage and position the housing 1.

The opening roller 2 combs individual fibers 13 out of the tufts 12 of the sliver 4 that are separated by the drawing-in roller 6 at the drawing-in trough 8. The combing is accomplished by the clothing 3 and the combed-out fibers 13 are carried along by the flow of air in the housing 1, which air flow can be produced by the vacuum at the spinning rotor. The light fibers 13 follow the air flow to the fiber discharge opening 18 and the heavier trash 14 is separated out through the trash discharge opening 15 as a result of the centrifugal force created by the rotating opening roller. In this manner the trash 14 falls into a collecting device ior some other means of conventional removal that does not require illustration or description herein.

The trash discharge opening 15 is defined by wall portions 16 and 17 formed integrally in the housing 1. These wall portions 16 and 17 prevent the trash from flowing back into the housing 1, which could occur due to uncontrolled air flow if no wall portions were provided. In the direction of rotation of the opening roller 2 indicated by the arrow, the housing 1 extends beyond the trash discharge opening 15 and the wall portions 16,17 are inclined at such an angle to the circumference of the opening roller 2 that trash 14 is cast out in an optimum manner due to the centrifugal forces acting on it without being cast back by bouncing off the walls 16,17.

The separate combed-out fibers 13 from which the trash 14 has been separated are guided by the air flow through the fiber discharge opening 18 in the housing 1 into a fiber guide tube 19 through which the fibers pass to the rotor (not shown). As the housing 1 is pivotally mounted, the fiber guide tube 19, which is stationary, is not connected to the housing 1, but the opening of the tube 13 at the fiber discharge opening 18 of the housing 1 is sufficiently large to maintain communication with the opening over the range of pivoting of the housing 1.

As seen in FIG. 1, the housing 1, including the drawing-in trough 8, is an integral element throughout, which is particularly significant in the path of fiber flow from the drawing-in opening 7 past the trash discharge opening 15 and wall portions 16,17 to the fiber discharge opening 18 to, thereby, minimize crevices that would otherwise tend to entangle fibers and cause accumulation of fibers into clumps that adversely affect yarn quality.

As seen in FIG. 2, the housing 1 is pivotally mounted in the spinning unit 11 and is retained therein by retaining ring 20 that engages in a groove 21 of the housing 1. The shaft 9 of the opening roller 2 is mounted in the housing 1 for extension from a conventional drive to the opening roller 2 in the housing 1.

The opening surface 3 of the roller 2 is confined between two lateral edge flanges 22 projecting from the opening roller 2. These flanges 22 serve the purpose of confining fibers within the working area of the opening roller 2 so that they do not move laterally away from the working surface into the area between the opening roller 2 and the housing 1. For a somewhat similar purpose the trash discharge opening 15 is of a width no greater than the width of the fiber opening surface 3.

The drawing-in opening 7 of the housing 1 and the drawing-in trough 8 are illustrated at the right in FIG. 2, which also illustrates the housing 1 having a closure plate 23 on the side opposite the side from which the shaft 9 extends. This plate 23 is attached for easy removal (not shown) for ready access into the housing.

With this construction, the circumferential crevice 24 at the joint between the housing 1 and plate 23 is the only location in the housing where there is a reasonable possibility of fibers or trash settling, and the circumferential flanges 22 of the opening roller 2 significantly prevent fibers or trash from reaching this joint 24.

Figure 3:
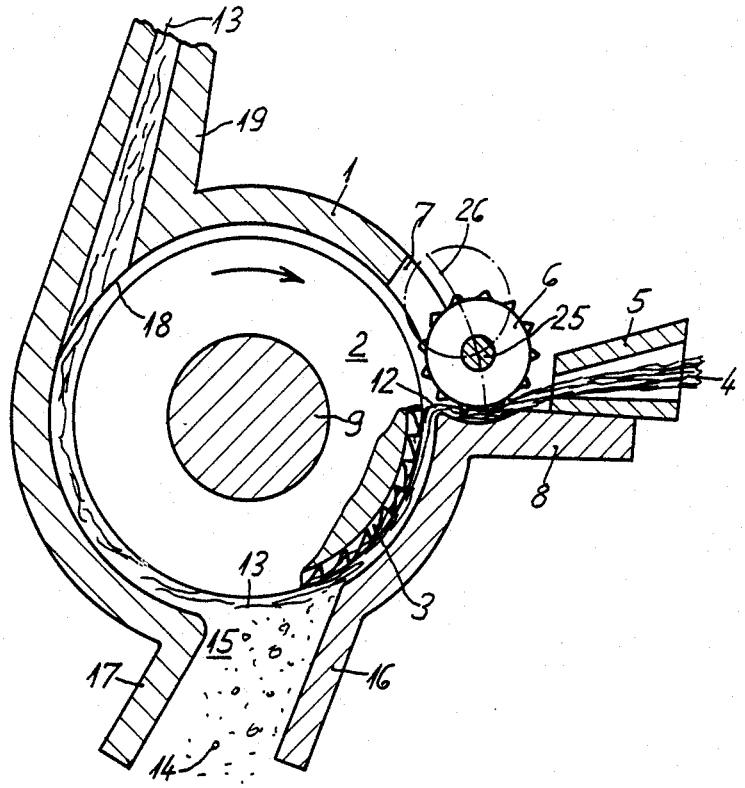
FIG. 3 is a view similar to FIG. 1, illustrating an alternate embodiment of the fiber opening device of the present invention.

An alternate embodiment of the present invention is illustrated in FIG. 3, wherein components similar to those of the embodiment of FIGS. 1 and 2 are identified by the same reference numerals. In contrast to the embodiment of FIGS. 1 and 2, the housing 1 of the embodiment of FIG. 3 is stationary, rather than being pivotally mounted, on the spinning unit and, therefore, the housing 1 can be fixed to or integrally constructed with the fiber guide tube 19.

In this embodiment of FIG. 3, the drawing-in roller 6 is mounted on a shaft 25 that is movable in the circular arc designated by the reference numeral 16 concentrically with the center of the opening roller shaft 9 to allow relative movement of the drawing-in roller 6 with respect to the housing 1 and adjacent drawing-in trough 8 when variations in the sliver pass the drawing-in roller 6. The drawing-in roller shaft 25 is conventionally urged by springs (not shown) into position shown in solid lines in FIG. 3 while accommodating sliver enlargements by movement to the position indicated by the dash-dot line.

If desired, the housing of either embodiment described above can be formed with an additional trash discharge opening (not illustrated) in the circumference of the housing 1 in advance of the wall portion 16. In this arrangement the two trash discharge openings are located in sequence to eliminate coarser trash through the first opening in the direction of rotation and the finer or lighter trash through the second opening.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A fiber opening device in a spinning unit of an open-end spinning machine comprising an opening roller, a housing surrounding said opening roller and having a drawing-in opening, a trash discharge opening and a fiber discharge opening, a drawing-in roller at said drawing-in opening, and a drawing-in guide trough for guiding a strand of fibers to said drawing-in roller and drawing-in opening, said drawing-in guide trough being formed integrally with said housing, said housing extending integrally from said drawing-in trough to said fiber discharge opening, and said housing and drawing-in roller being relatively movable.

2. A fiber opening device according to claim 1 and characterized further in that said housing is mounted for pivoting about the axis of said opening roller, and by a stationary fiber guide tube for receiving fibers from said fiber discharge opening of said housing.

3. A fiber opening device according to claim 1 and characterized further in that said housing is stationary and said drawing-in roller is mounted for movement relative to the housing and drawing-in guide trough.

4. A fiber opening device according to claim 1, 2 or 3 and characterized further in that said housing includes integral wall portions defining said trash opening.

5. A fiber opening device according to claim 1, 2 or 3 and characterized further in that said opening roller has a fiber opening surface thereon and said trash discharge opening is of a width no greater than the width of said fiber opening surface.

6. A fiber opening device according to claim 4 and characterized further in that said opening roller has a fiber opening surface thereon and said trash discharge opening is of a width no greater than the width of said fiber opening surface.

7. A fiber opening device according to claim 1, 2 or 3 and characterized further in that said opening roller includes a drive shaft rotatably mounted in said housing.

* * * * *

UNITED STATES PATENT AND TRADEMARK OFFICE

CERTIFICATE OF CORRECTION

PATENT NO. : 4,825,637

DATED : May 2, 1989

INVENTOR(S) : Heinz-Georg Wassenhoven

It is certified that error appears in the above-identified patent and that said Letters Patent is hereby corrected as shown below:

On the Abstract page, under "Foreign Application Priority Data" the number of the German Patent is incorrect:

Delete "3715934" and insert therefor --37 16 727. --.

Signed and Sealed this

Twenty-first Day of May, 1991

*Attest:*

HARRY F. MANBECK, JR.

*Attesting Officer*

*Commissioner of Patents and Trademarks*